US005567321A

United States Patent [19]

Weber et al.

[11] Patent Number: 5,567,321

[45] Date of Patent: Oct. 22, 1996

[54] CENTRIFUGAL FILTER

[75] Inventors: Eduard Weber, Seon; René Rohr, Hunzenschwil; Jürg Suter, Schafisheim, all of Switzerland

[73] Assignee: Ferrum AG, Rupperswil, Switzerland

[21] Appl. No.: 386,071

[22] Filed: Feb. 9, 1995

[30] Foreign Application Priority Data

Mar. 14, 1994 [CH] Switzerland ..... 740/94

[51] Int. Cl.[6] ..... B04B 3/00; B04B 3/02

[52] U.S. Cl. ..... 210/376; 210/369; 210/380.1; 210/396; 494/36

[58] Field of Search ..... 210/107, 109, 210/360.1, 369, 373, 374, 375, 376, 391, 396, 380.1; 494/36

[56] References Cited

U.S. PATENT DOCUMENTS 4,894,171 1/1990 Nichols ..... 210/772
5,370,791 12/1994 Lescovich et al. ..... 210/396

FOREIGN PATENT DOCUMENTS 2706733 8/1978 Germany .
56-65646 6/1981 Japan .

*Primary Examiner*—David A. Reitsnyder
*Attorney, Agent, or Firm*—Bucknam and Archer

[57] ABSTRACT

The centrifugal filter comprises a rotatable travelling basket (5) disposed within a collector chamber (1). A machine body (2) which can be supported on a support (3) carries a bearing arrangement (8) for the hub (14) of the travelling basket (5). In the travelling basket (5) which partially comprises holes is present a filter element (20) in such a way that during the rotation of the travelling basket the liquid to be filtered can flow out through the filter element (20) and through these holes. For removing the filtrate, retained on the filter element and consisting of solid particles, a lifting device (22) is present which can be moved back and forth. The travelling basket (5) comprises a travelling basket neck (7) connected with the travelling basket hub (14), which neck is provided with passage openings which communicate at least partially with further passage openings disposed in the bottom portion of the machine body (2).

21 Claims, 4 Drawing Sheets

FIG. 1
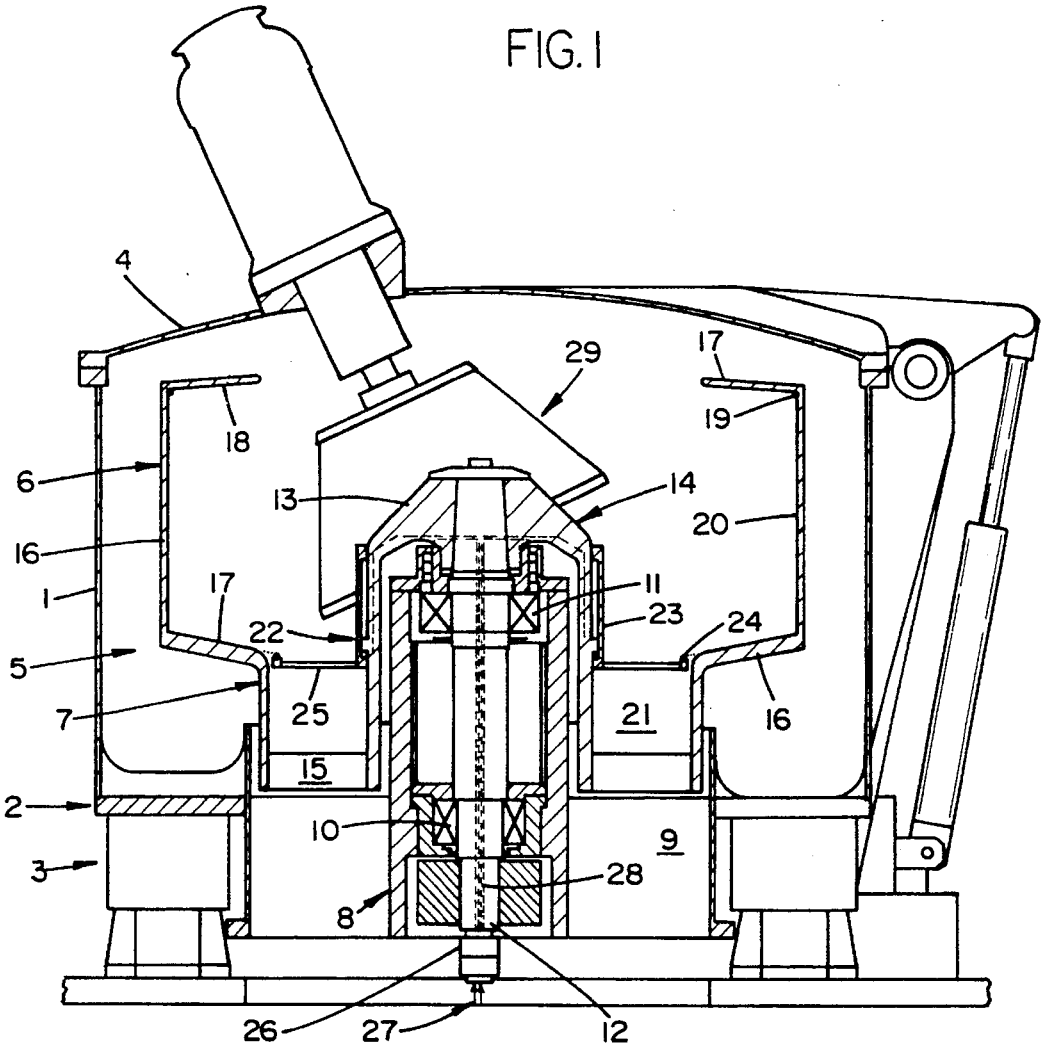
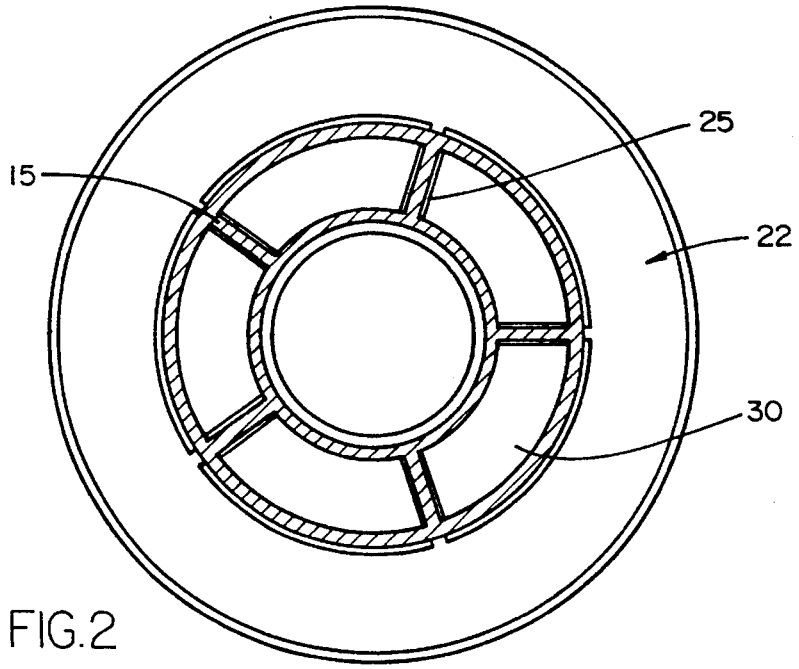
FIG. 2

CENTRIFUGAL FILTER

FIELD OF THE INVENTION

The present invention relates to a centrifugal filter.

BACKGROUND OF THE INVENTION

For separating particles from liquids, centrifuges with rotating barrels or travelling baskets are often used, in which the filtrate formed by the solid particles is retained as a residue on a filtering cloth or filtering bag. For the removal of residual layers from the barrel a mechanism is, for example, used therein which carries out a mechanical scraping of the barrel wall.

Such device have been found to be disadvantageous in view of the fact that the removal of residual layers is relatively involved.

It is therefore the object of the present invention to create a centrifugal filter which permits the efficient emptying of the travelling basket.

SUMMARY OF THE INVENTION

A significant advantage of the centrifugal filter according to the invention resides therein that, in contrast to known mechanical scraping blades which are unsuitable for scraping residual layers for example up to 4 or 5 mm in particular at the edges, they permit the complete emptying of the filtering cloth.

A further advantage of the centrifugal filter according to the invention is that, in contrast to the emptying scraping blades which destroy filtered-out crystals, it is exceptionally well suited for removing crystals carefully.

BRIEF DESCRIPTION OF THE DRAWINGS

In the following the invention will be explained by example in further detail with reference to the drawings of which FIG. 1 a schematic representation in section of a first embodiment of a centrifugal filter according to the invention, FIG. 2 a schematic cross-sectional representation of the lifting device of such centrifugal filter, FIG. 3 a schematic sectional representation of the collector chamber of this centrifugal filter, FIG. 4 a schematic top view onto this collector chamber, FIG. 5 a representation according to FIG. 1, however, with filter cake, FIG. 6 a representation according to FIG. 1, however, with a filtering cloth stretched downwardly, FIG. 7 a schematic representation in section according to a second embodiment of a centrifugal filter according to the invention, and FIG. 8 a representation according to FIG. 7, however, with a filtering cloth stretched upwardly.

The centrifugal filter according to FIG. 1 comprises a resting collector chamber 1 preferably realized in annular form, which rests over a machine body 2 on a support 3 and is closed with a cover 4. Within the collector chamber 1 is disposed a travelling basket 5 with a barrel 6 and a travelling basket neck 7. The machine body 2 encompasses a bearing housing 8 with fixed ribs 9 (FIG. 4). In the bearing housing 8 are disposed a lower bearing 10 and an upper bearing 11 for the drive shaft 12 of the travelling basket 5. The upper part of the drive shaft 12 is connected with the shaft head 13 of a travelling basket hub 14 whose lower portion is connected with ribs 15 implemented in the lower portion of the travelling basket neck 7. The barrel 6 of the travelling basket 5 is implemented so as to be approximately C-shaped and encompasses a center vertical barrel shell 16, a lower barrel bottom 17 approximately radial and an upper annular barrel cover wall 18, approximately radial. The barrel bottom 17 is implemented as a connection between the travelling basket neck 7 and the barrel shell 16. The travelling basket 5 which consequently comprises the elements 18, 16, 17, 7 (15), 14 (13), and 12, is therefore supported in the centrifugal filter so as to be vertically rotatable via bearings 10 and 11.

Figure 3:
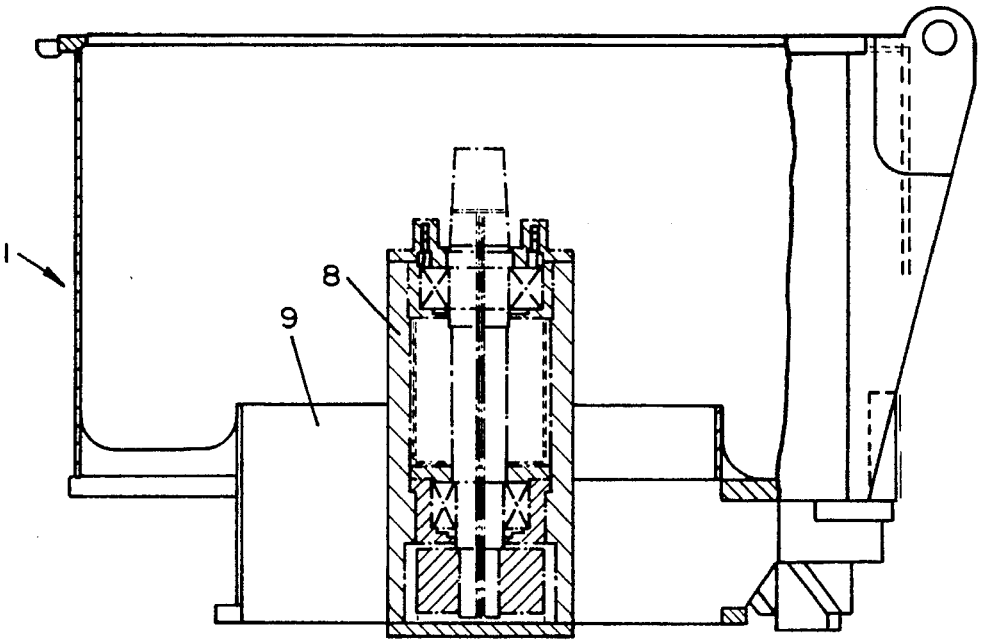

In the upper region of the barrel shell 16 is disposed in the interior an annular fastening device 19 for a filter element 20, for example a filtering cloth or a filtering bag. The vertical portion of the travelling basket neck 7 and the vertical lower portion of the travelling basket hub 14 define an annular-cylindrical displacement volume into which a filter clamp device or lifting device can be partially shifted, comprising a vertical piston 23 and an outer fastening device 24 connected with it via radial ribs 25, which can be, for example, a filter fastening ring.

The piston 23 is actuated electrically or hydraulically in order to move it in the vertical direction. For this purpose the drive shaft 12 can, for example, be connected via a hinge-rotary head 26 with corresponding fluidic connections 27. The rotary head 26 comprises a packing head for two separate fluidic circulations 28, in FIG. 1 only indicated, for transmitting fluid pressure from the stationary machine body 2 to the rotating drive shaft 12. The pressure is carried through the drive shaft 12 and through the travelling basket hub 14 onto the piston 23.

The upper portion of the centrifugal filter can be realized according to prior art with an oblique filling dish 29 or with a filling dish or with a filling tube.

FIG. 2 shows that the lifting device 22 can comprise, for example, five ribs 25, which are congruent with the five ribs 15 of the travelling basket 5. Between these ribs are present five passage openings 30.

Figure 4:
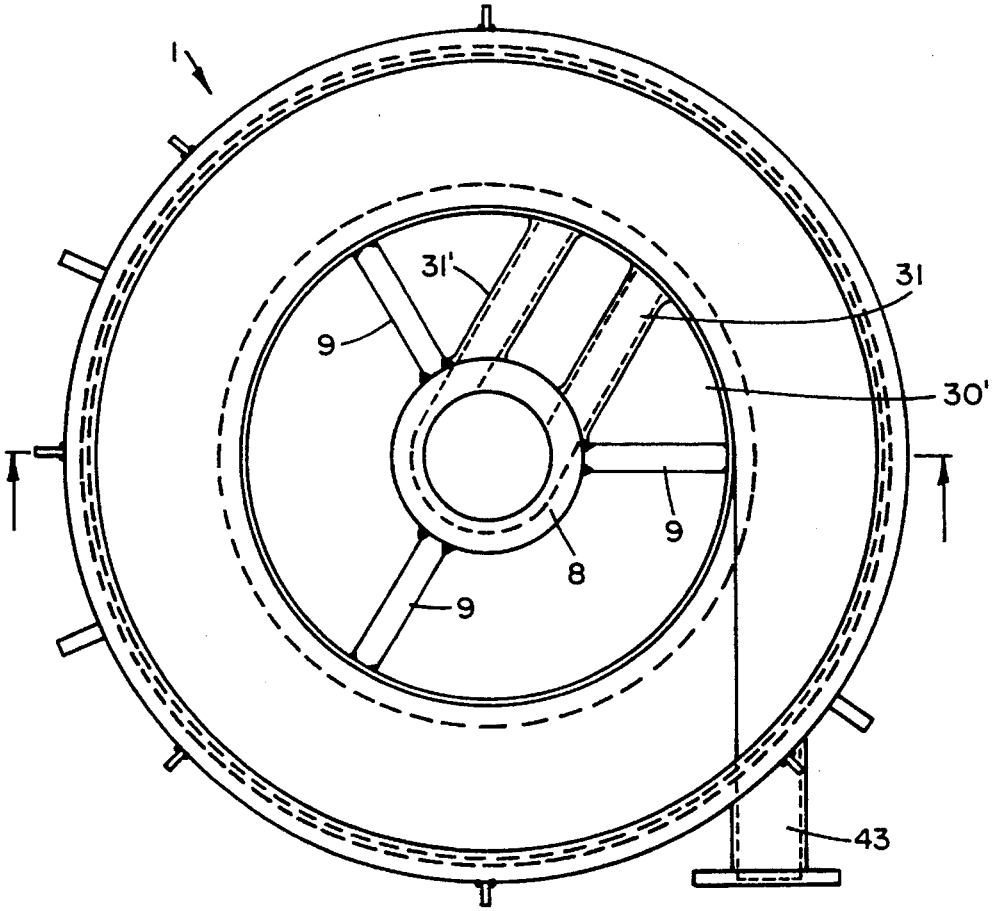

FIGS. 3 and 4 show that the outer portion of the collector chamber 1 is connected via three ribs 9 with the bearing housing 8, and that between these three ribs 9 passage openings 30' are present in order to make possible communication with the so-called product volume. Furthermore are provided two passage channels 31, 31', isolated from the product volume, in which the drive belts for the motion of the drive shaft 12 are disposed.

The centrifugal filter according to FIGS. 1 to 6 functions in the following manner:

The barrel shell 16 is provided in the customary manner with holes, not depicted in the drawing so that the liquid can flow out by centrifugal force when the travelling basket 5 is rotated.

The supplied liquid containing solid particles in suspension is sprayed laterally at the bottom through centrifugal force from a potentially rotating ejector in the collector chamber 1. Since barrel 6 also rotates, the liquid moves through the pores or mesh of the filtering cloth 20 or 20' and through the holes of the barrel shell 16 into the collector chamber 1, from which it can escape through the drainage tube 43 (FIG. 4). Through the centrifugal force of the rotating barrel 6 the coating or cake formed by the solid particles is generated in the interior of the filtering cloth.

Figure 5:
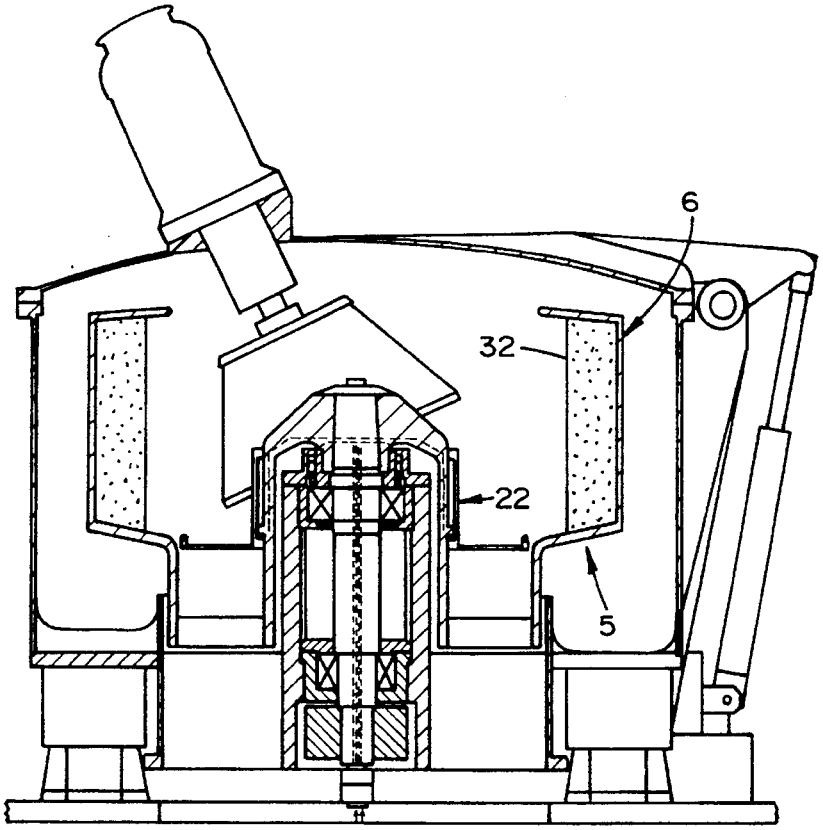
Figure 6:
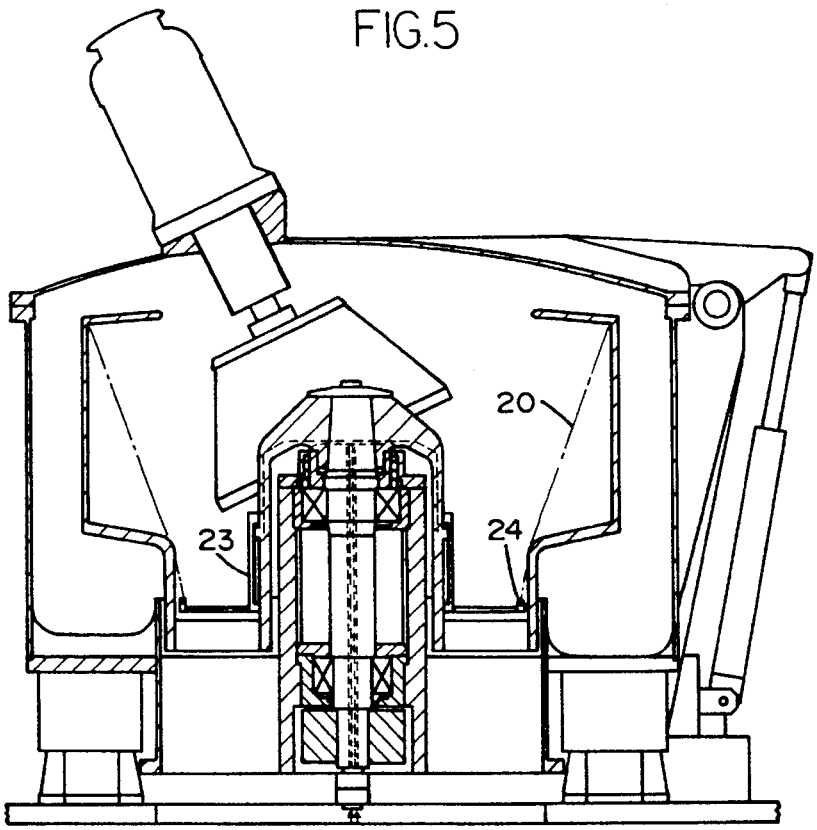

The filter element, filtering cloth or the like is held at the top by fastening device 19 (FIG. 1) and at the bottom through filter fastening ring 24. In the normal position the filter fastening ring 24 is located in the upper region of the travelling basket neck 7, as depicted in FIGS. 1 and 5. The travelling basket 5 can be filled in the three ways mentioned above and FIG. 5 depicts the position of cake 32 if the barrel 6 is full. For emptying the centrifuge the travelling basket 5 is slowed down to emptying speed. Via a rotary button the lifting device 22 is pressurized with compressed gas or electrically and thereby brought into the lower final position so that the filter fastening ring 24 pulls the lower edge of the filter element 20 in the downward direction which is forced into a conical shape according to FIG. 6. Through this mechanical deformation of the filter element the cake 32 (FIG. 5) is detached which subsequently, due to gravity, slides through the passage openings 30 and 30' from the machine which represents a very clean and fast operation. Subsequently the piston 23 is actuated in order to move it into its zero position (upper position) so that the next charging process can be started.

In the embodiment according to FIG. 7 and 8 the filter element is fixed below, for example in the upper region of the travelling basket neck 7 through a filter fastening device 33. The filter element or filtering cloth, which in this case is also realized cylindrically, at least in a central region, so that it can rest in the interior of the travelling basket 5, is fastened above with the aid of a fastening device 34 on a cover device 35 which covers the inner opening of an annular barrel cover wall 18'. The collector chamber in this case is closed with a cover 4' comprising a center tubular holding device 36 for a lifting body 37, which comprises a lifting platform 38 and a longitudinal guidance 39 on which a guidance sleeve 40 for a filling tube 41 is rotatably supported. The holding device 36, longitudinal guidance 39, guidance sleeve 40 and the filling tube 41 are disposed coaxially with little free motion such that the guidance sleeve 40, connected below with the cover device 35, can rotate with it and, consequently, also with the travelling basket 5 even if parts 36, 39 and 41 are at rest. For this purpose two axial bearings each are provided in the lower and in the upper region of this part. The platform 38 is connected movably via a mechanical, electrical, pneumatic or hydraulic mechanism 42 (FIG. 8) with the holding device 36 or with the cover 4' in such a way that the cover 35 can complete a vertical lifting motion in order to pull the filtering cloth 20' upward (FIG. 8). The operating function of the centrifugal filter according to FIGS. 7 and 8 is similar to the embodiments according to FIGS. 5 and 6 with the difference that the filter element is stretched upwardly.

Figure 7:
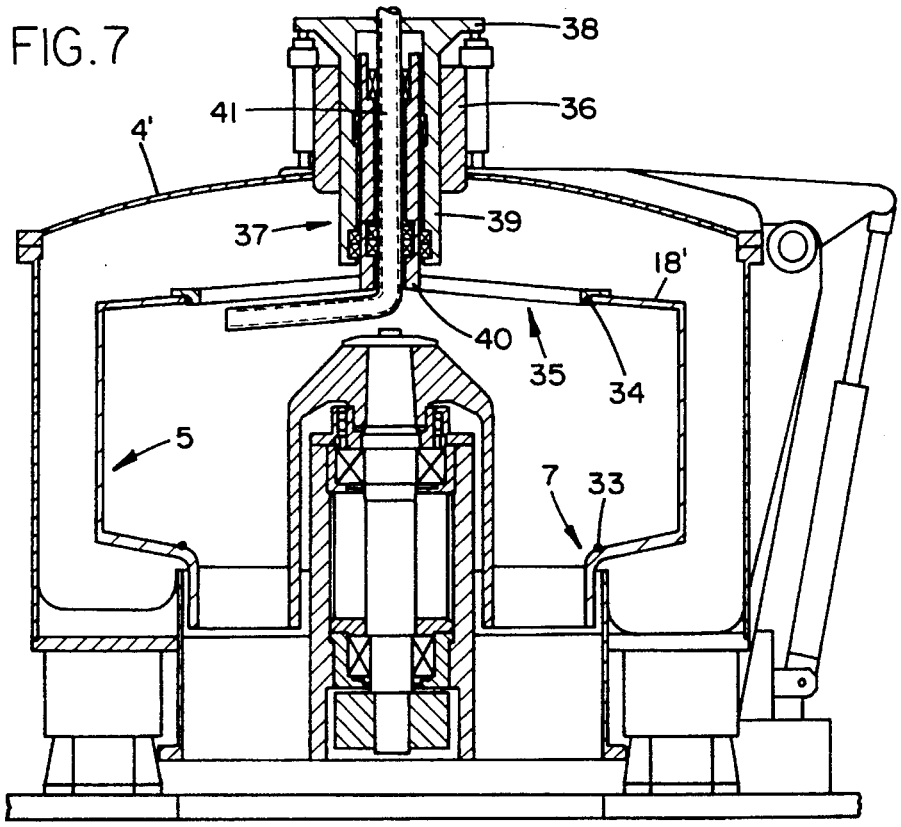
Figure 8:
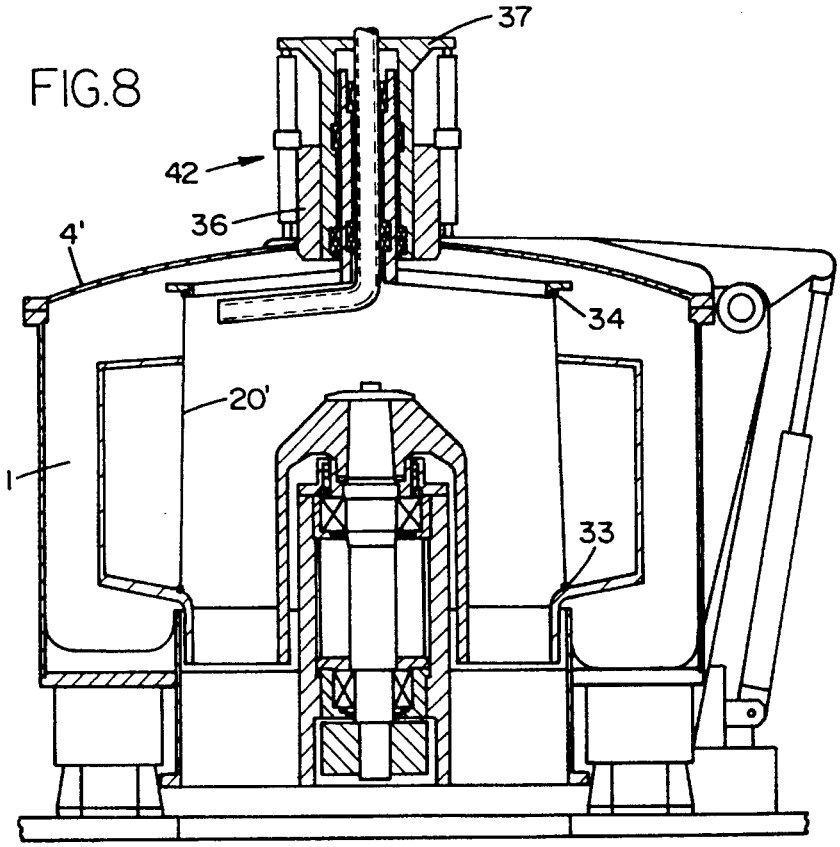

The filtering cloth 20, 20' is preferable connected frictionally or detachably with the filter fastening ring 24 or 33 and with the fastening device 19 or 34 (FIG. 7). Since the inner diameter of the barrel shell 16 (FIG. 1) is greater than the outer diameter of the travelling basket neck 7, it is possible for several longitudinal, at least approximately vertically directed, folds distributed over the circumference to develop in an at least approximately cylindrical filtering cloth 20 or 20'. For this purpose, the filtering cloth is realized so as to be relatively flexible so that, due to the folds, it can be pressed more or less closely against the inner side of the barrel shell 16 through the centrifugal force.

The cover 4 or 4' can be provided with a nitrogen inlet so that the collector chamber forms a completely closed system exposed to $N_2$.

In the centrifugal filter according to FIG. 1 or FIG. 7, consequently, the height of the collector chamber 1 is greater than the height of the barrel shell 16, in order to separate within the collector chamber 1 with the aid of the lifting device 22 or 42 the ring 24 or 34 from the barrel edge and to shift it so far downward or upward that the filtering cloth is completely stretched. The filtering cloth 20 or 20' must be so flexible and dimensioned so that, in spite of its funnel form proper, assumed preferably through the folds, it can adapt well to the inner wall of the barrel shell 16.

In a further embodiment of the invention the cover 4, 4' can be opened and subsequently shifted and/or pivoted laterally in order to permit opening the entire centrifugal filter.

The collector chamber 1 can be provided with a further opening in order to generate a vacuum so that the filtration can be accelerated. In this case, the nitrogen inlet can be closed or it can be omitted. It is understood that such openings can also be provided with valves.

In a further embodiment of the invention the collector chamber 1 and the travelling basket 5, which according to prior art can comprise stainless steel in various qualities, are protected on the inside with a plastic coating comprising, for example, Teflon.

Between the filtering cloth 20 or 20' and the barrel shell 6 a support net can be present. During the filtration the lower termination of the bearing arrangement can be closed with a covering not depicted in the Figures. Emptying the filtering clothing can also be carried out by shaking the clamping ring with the aid of the lifting device 22 or 42.

In practice, for centrifugal filters of this type preferably filtering cloths can be used comprising polypropylene or Teflon having a thickness of for example 1 mm and a mesh size of 5 to 100 μm.

According to another embodiment of the invention the bearing of the travelling basket can be disposed on the outside between the machine body and the travelling basket neck which in this case comprises a center opening whose diameter is smaller than the inner diameter of the ball bearing, which can be used for example for supporting the travelling basket. Such support can comprise, for example, an upper ball bearing and a lower angular bearing. The travelling basket which, thus, is disposed so as to be rotatable about a vertical axis and whose neck is thus realized as hollow driving shaft, communicates via the center opening of the travelling basket neck with a lower emptying volume for the separated solid particles. In this embodiment a part of the lifting device can also be mounted stationarily on the outside so that it can also be actuated purely mechanically as shown in the example according to FIG. 7.

It is evident from FIGS. 1, 3, 7, and 8 that the travelling basket hub 14 can, for example, extend from the travelling basket neck 7 to a relatively high point in the inner region of the travelling basket.

We claim:

1. A centrifugal filter, comprising:

a) a collector chamber;

b) a machine body supporting said collector chamber;

c) a rotatable filter basket having a perforated barrel and a basket neck, said filter basket being disposed in the interior of the collector chamber;

d) a bearing housing having a bearing device comprising a rotatable drive shaft for the filter basket, said machine body having a portion supporting said bearing housing and having at least one opening;

e) a hub driven by said drive shaft and connected with a portion of said basket neck, wherein said portion of said basket neck has at least one basket neck bottom opening;

f) a filter element having a first edge connected with the filter basket; and g) lifting means to which is connected a second edge of said filter element so as to move said second edge in a direction between a folded position of said filter element and a stretched position of said filter element.

2. The centrifugal filter as defined in claim 1, wherein the connection of said second edge of said filter element to said lifting means defines a space which together with said at least one opening of said portion of said basket neck defines a passage of said basket neck.

3. The centrifugal filter as defined in claim 2, wherein the connection of said second edge of said filter element to said lifting means comprise connection ribs forming spaces between them which together with the opening of the portion of said basket neck defines said passage of said basket neck.

4. The centrifugal filter as defined in claim 1, wherein the portion of the basket neck comprises ribs which form spaces therebetween which are openings of said filter basket neck portion.

5. The centrifugal filter as defined in claim 1, wherein the portion of said machine body supporting said bearing housing comprises a plurality of ribs forming spaces therebetween which are openings of said portion of the machine body.

6. The centrifugal filter as defined in claim 1, wherein said first edge of the filter element is connected via a first fastening device with the filter basket and said second edge of the filter element is connected via a second fastening device with a movable part of said lifting means.

7. The centrifugal filter as defined in claim 1, wherein the distance between said first fastening device and the lifting means is greater than the distance between said second fastening device and the lifting means.

8. The centrifugal filter as defined in claim 1, wherein said lifting means is coaxially disposed with respect to said basket hub and a first part of said lifting means is fixedly connected with said basket hub and a second part is movable and connected with the second edge of said filter element.

9. The centrifugal filter as defined in claim 1, wherein said basket hub comprises a shaft head for said drive shaft and at least one channel for a fluid actuating said lifting means.

10. The centrifugal filter as defined in claim 1, wherein the basket neck comprises an annular free space containing a movable part of said lifting means.

11. The centrifugal filter as defined in claim 1, wherein the lifting means is supported by a cover of the collector chamber.

12. The centrifugal filter as defined in claim 11, wherein a movable part of said lifting means is connected with a cover device for the filter basket and wherein the second edge of said filter element is connected to the filter basket.

13. The centrifugal filter as defined in claim 1, wherein said perforated barrel includes a perforated barrel shell and a barrel bottom implemented as a connection between said barrel shell and said basket neck and wherein the diameter of the perforated barrel shell is greater than the diameter of the basket neck.

14. The centrifugal filter as defined in claim 1, wherein said lifting means is a hydraulically actuated piston device.

15. The centrifugal filter as defined in claim 1, wherein said lifting means is an electrically actuated piston device.

16. The centrifugal filter as defined in claim 1, wherein said lifting means is a pneumatically actuated piston device.

17. The centrifugal filter as defined in claim 1, wherein the filter element is a filtering cloth or bag fixed in the upper region of the perforated barrel.

18. The centrifugal filter as defined in claim 1, wherein the filter element is a filtering cloth or bag.

19. The centrifugal filter as defined in claim 1, wherein the machine body has two isolated passage channels in which drive belts for the motion of the drive shaft are disposed.

20. The centrifugal filter as defined in claim 1, wherein the collector chamber is closed with a cover including a center tubular holding device for a lifting body which comprises a lifting platform and a longitudinal guide on which a guide sleeve for a filling tube is rotatable supported, and wherein the guide sleeve is connected with the connection connecting said second edge of said filter element with said lifting body.

21. The centrifugal filter as defined in claim 1, wherein the collector chamber is connected to a drainage tube.

* * * * *